US005303980A

United States Patent [19]

Young

[11] Patent Number: 5,303,980

[45] Date of Patent: Apr. 19, 1994

[54] CHILD THEATER BOOSTER SEAT

[76] Inventor: Terry W. Young, 1214 Moorehead Pl., Pendleton, S.C. 29670

[21] Appl. No.: 92,389

[22] Filed: Jul. 14, 1993

[51] Int. Cl.[5] ..... A47D 1/10

[52] U.S. Cl. ..... 297/251; 297/248

[58] Field of Search ..... 297/248, 251, 153; 108/64

[56] References Cited

U.S. PATENT DOCUMENTS

| | | | |
|---|---|---|---|
| 390,407 | 10/1888 | Sloat . | |
| 1,247,161 | 11/1917 | Silverman . | |
| 2,852,785 | 9/1958 | Mikola . | |
| 3,328,811 | 7/1967 | Norton | 297/251 X |
| 4,995,668 | 2/1991 | Ziuari | 297/248 |

*Primary Examiner*—Peter R. Brown

*Attorney, Agent, or Firm*—Gerald Boss; Cort Flint

[57] ABSTRACT

A child theater booster seat A is combined with a second respective of a child theater booster seat A1 to form an assembly of children theater booster seats B. Assembly B is supported by a row of theater seats C having arm rests 10. Child theater booster seat A includes a seat platform 12 for seating a child, a first side wall 14, a second side wall 16, a first support arm 18, a second support arm 20. Interlocking assembly 21 interlocks booster seat A with a second respective of child theater booster seat A1. Interlocking assembly 21 includes a male extension 22 and a female receptacle 24.

20 Claims, 2 Drawing Sheets

Fig. 3.
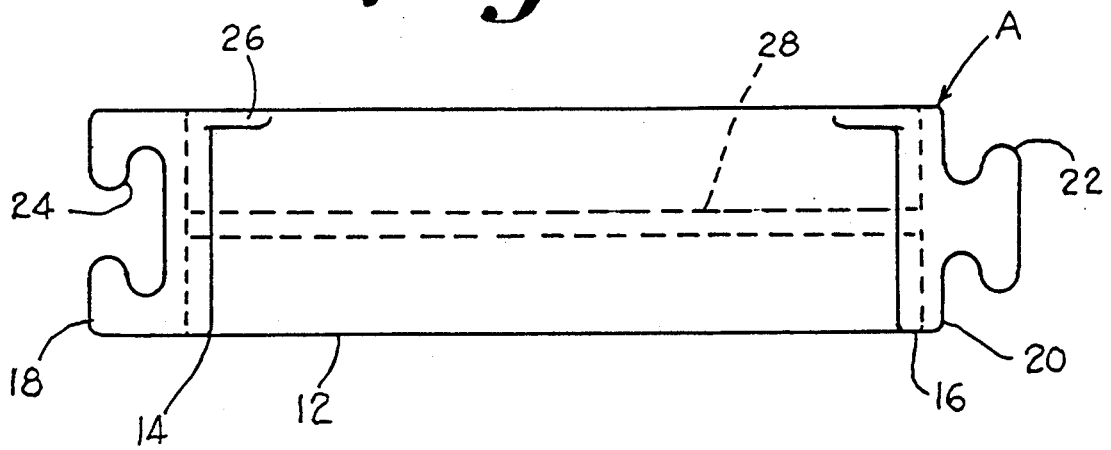
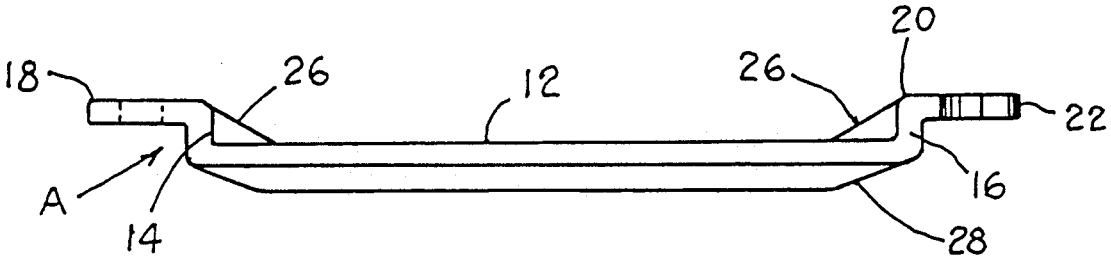
Fig. 4.
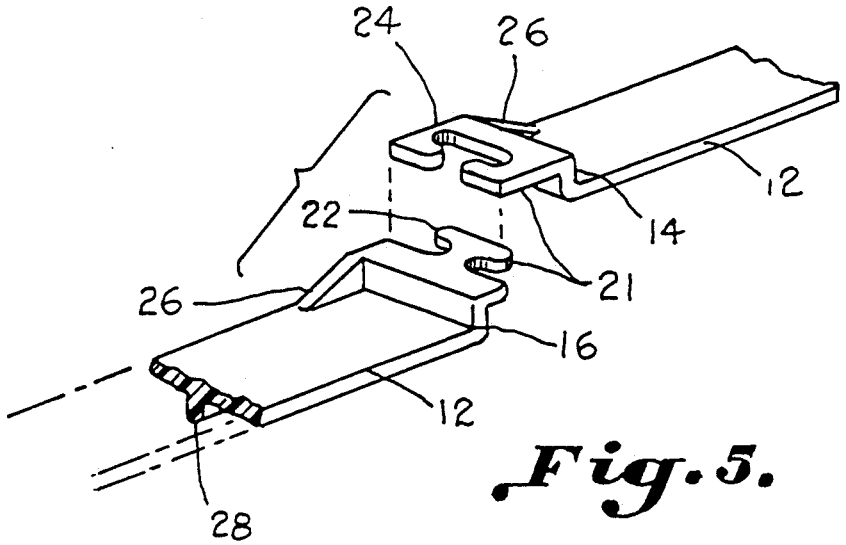
Fig. 5.

CHILD THEATER BOOSTER SEAT

BACKGROUND OF THE INVENTION

The invention relates to a booster seat for supporting a child or a small individual in a standard adult seat, and more particularly to a child theater booster seat for use in a row of adult theater seats having an interlocking means for interlocking a first respective of the child theater booster seat with a second respective of the child theater booster seat.

As illustrated in U.S. Pat. No. 390,407 booster seats have been used in bath tubs for providing a temporary seat for an individual. Additionally, U.S. Pat. No. 1,247,161, illustrates the use of a booster seat in a barber shop chair.

With the increasing popularity of movies for young children, a need for a booster seat for a theater has developed. The current theater seat has a seat depth designed for a normal adult with no seats designed for children. When a child uses the current adult theater seat, the child generally stands in the seat in order to view the screen.

The standing in the adult seat by the child presents two problems. The first is that most adult theater seats are designed with a bias to spring the chair up and inward when the chair is not in use. Having a child standing in a chair that is biased upward and inward is unsafe because for smaller children who lack the resistance to maintain the adult theater seat downward, the seat biases upward possibly bending the child's legs and thus creating an uncomfortable viewing environment. The second problem that is created by a child standing in the theater seat is that the standing child is generally taller than a seated adult and hence restricts the viewing of the movie by theater patrons behind the child.

Furthermore, most booster seats are designed to be used with a solitary stand-alone structure such as the bath tub or barber chair. Audiences are common in which numerous children view the movie at one viewing. With the standard design of theater seats being in rows and having a common arm shared between seats, the standard booster seat is inadequate.

Accordingly, an object of the present invention is to provide a child theater booster seat that can be used in a row of theater seats;

Furthermore, an object of the present invention is to provide a child theater booster seat which will place the child at an appropriate height to view the theatrical presentation without interfering with the view of other theater patrons;

Additionally, an object of the present invention is to provide a child theater booster seat which can be interlocked with a second child theater booster seat securing the seats to provide safe viewing for the respective children;

A further object of the present invention is to provide a child theater booster seat which is light-weight and can be manufactured economically.

SUMMARY OF THE INVENTION

The above objectives are accomplished according to the invention by providing a child theater booster seat for use in a row of theater seats having arm rests for facilitating the viewing of movies and the like by children. The child theater booster seat includes a seat platform for supporting the child. A plurality of side walls extend from the seat platform and end in a plurality of support arms. The support arms extend outward from the side walls and overlap the arm rests of the theater seat for supporting the seat platform and the child.

The plurality of support arms include an interlocking means for interlocking the child theater booster seat with a second respective of the child theater booster seat. The interlocking feature enables a plurality of booster seats to be secured along the same theatrical row allowing a plurality of children to use the booster seats adjacent to each other.

The child theater booster seat is designed such that the seat platform is suspended by the support arms within the profile of the adult theater seat to a position directly above the theater seat. The support arms are integral with the seat's platform in a configuration enabling the seat platform and support arms to be placed adjacent to the backrest of the adult theater seat. This configuration enables the child theater seat to be squared against the existing back rest of the adult theater seat comfortably supporting the child's back and providing a stable seating position.

Furthermore, the existence of an interlocking means for interlocking multiple child theater seats provides a safe viewing environment for children. With two theater seats interlocked, the weight of the children stabilizes the seats and prevents the seats from becoming unaligned with the original squared position against the back rest.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 3 is a top view of a child theater booster seat according to the invention;

FIG. 4 is a front view of a child theater booster seat according to the invention;

FIG. 5 is a sectional view of the interlocking assembly of two child theater booster seats according to the invention.

DESCRIPTION OF A PREFERRED EMBODIMENT

Figure 1:
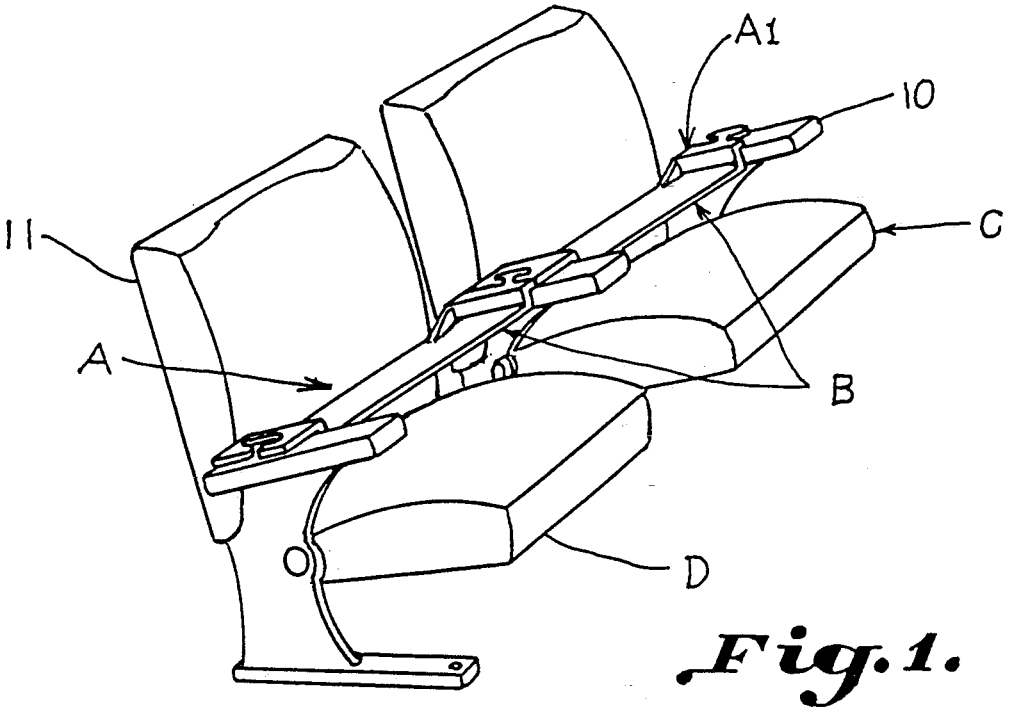
FIG. 1 is a prospective view illustrating two child theater booster seats according to the invention interlocked together and supported by two adjacent adult theater seats.
Figure 2:
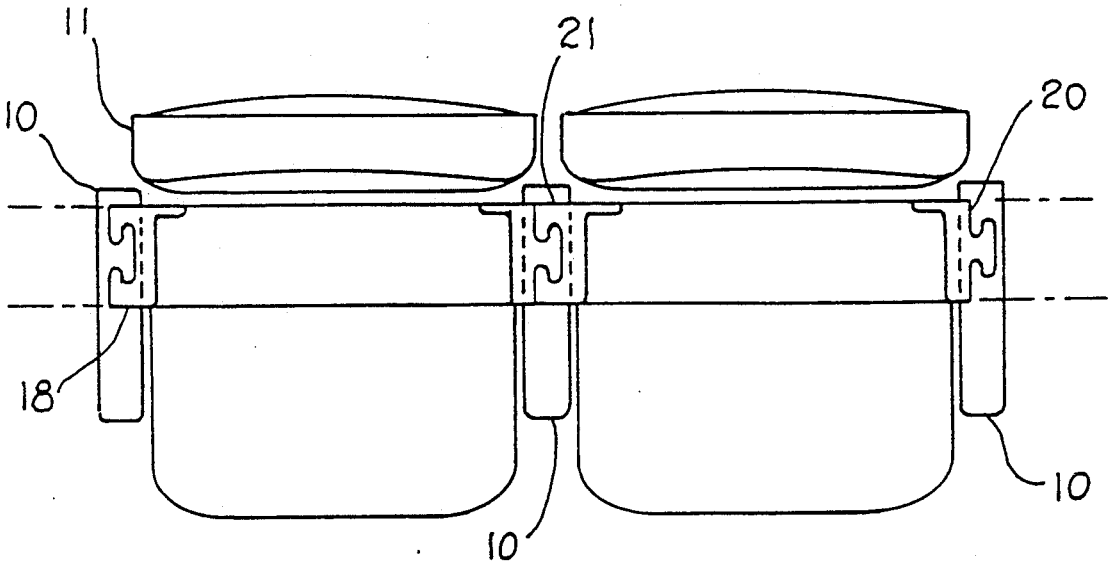
FIG. 2 is a top view illustrating two child theater booster seats according to the invention interlocked together and supported by two adjacent adult theater seats.

Referring in more details to the drawings, as shown in FIGS. 1 and 2, a child theater booster seat A is combined with a second respective of a child theater booster seat A1 to form an assembly of children theater booster seats B. Assembly B is supported by a row of theater seats C having arm rests 10, and back rests 11.

As shown in FIGS. 3 and 4, child theater booster seat A includes a seat platform 12 for seating a child. A first side wall 14 is integral with and extends upwardly away from seat platform 12. A second side wall 16 is integral with and extends upwardly away from seat platform 12. First side wall 14 ends in a first support arm 18. First support arm 18 extends perpendicularly outward from first side wall 14. Second side wall 16 ends in a second support arm 20. Second support arm 20 extends perpendicularly outward from second side wall 16 and opposite from first support arm 18. As shown in FIG. 2, first support arm 18 and second support arm 20 overlap arm rest 10 supporting child theater booster seat A in a suspended position enabling a child to sit generally within the standard profile of theater seat D.

As shown in FIGS. 1, 2, and 3 child theater booster seat A also has an interlocking means 21 for interlocking and securing the booster seat A with a second respective of the child theater booster seat A1. In the preferred embodiment, interlocking means 21 includes a male extension 22 and a female receptacle 24. As shown in FIG. 5, female receptacle 24 is configured to require male extension 22 to enter female receptacle 24 either from above or below female receptacle 24. Such a requirement interlocks child theater booster seat A with child theater booster seat A1 in one easy step and without any independent parts which may be lost or misplaced.

In the preferred embodiment, child theater booster seat A is a unitary piece molded from plastic. In order to maintain the right angles of first and second side walls 14 and 16 with seat platform 12 and consequently the contact of first and second support arms 18 and 20 with chair arms 10, child theater seat A includes a brace or gusset 26 integral with a respective side wall 14 or 16 and seat platform 12. Additionally, in order to maintain the rigidness of seat platform 12 and prevent any bowing of seat platform 12 when sat upon by a child, child theater seat A includes a support rib 28 co-extending generally along the bottom of seat platform 12.

Additionally, most adult theater seats are of a standard size, measuring twenty-four inches from outside the arms and seven and a half inches from the top of the seat to the top of the armrests. Child theater seat A is of a standard width and depth to enable utilization of child theater seat A with most adult theater seats currently used. The support arms 18 and 20 end in a common plane with seat platform 12 allowing booster seat A to be flush against backrest 11 providing a secure viewing position for the child.

Thus, it can be seen that an advantageous construction for a child's theater booster seat can be had according to the invention. The child seat is suspended within the profile of the adult theater seat and subsequently interlocked with another child seat. The seat assembly is pressed flush against the back rest of the existing adult seat. The combination of the plurality of the child theater booster seat interlocked with one another allows the weight of one child to secure the child booster seat of a second child preventing the child theater booster seat to move along the arm rest of the adult theater seat due to the natural fidgetiness of the child. These interlocking means combined with the seat being flush against the back rest provides a safe and secure viewing platform which is much safer than the current practice of having a child stand up in the theater seat. Furthermore, the child theater booster seat with structural reenforcements enables the seat to be made economically from light weight plastic while still affording a secure platform for the child to view the theatrical production.

While a preferred embodiment of the invention has been described using specific terms, such description is for illustrative purposes only, and it is to be understood that changes and variations may be made without departing from the spirit or scope of the following claims.

What is claimed is:

1. An assembly of children theater booster seats for facilitating the viewing of movies and the like by children or diminutive persons for use in a row of adult theater seats having spaced apart arm rests, said children theater booster seat assembly comprising:

a first child theater booster seat having a first seat platform for seating a first child;

a first plurality of side walls extending upwardly from opposing ends of said first seat platform;

a first plurality of support arms extending generally outward from said first plurality of side walls for overlapping said arm rests of a first adult theater seat and supporting said first seat platform whereby said first seat platform is suspended within said space separating said arm rests;

a second child theater booster seat having a second seat platform for seating a second child;

a second plurality of side walls extending upwardly from opposing ends of said second seat platform;

a second plurality of support arms extending generally outward from said second plurality of side walls for overlapping said arm rests of a second adult theater seat and supporting said second seat platform whereby said second seat platform is suspended within said space separating said arm rests;

a securing means for securing said first child theater booster seat with said second child theater booster seat.

2. The assembly of claim 1 wherein said securing means includes an interlocking assembly interlocking said first child theater booster seat with said second child theater booster seat.

3. The assembly of claim 2 wherein said interlocking assembly includes said first child theater booster seat having a male extension and said second child theater booster seat having a female receptacle for receiving said male extension whereby said first child theater booster seat interlocks with said second child theater booster seat.

4. The assembly of claim 1 wherein said child theater booster seats are unitary structures.

5. The assembly of claim 1 wherein said seat platforms and said plurality of support arms terminate in a common plane.

6. The assembly of claim 1 wherein said first child theater booster seat is molded from plastic.

7. The assembly of claim 6 wherein said first child theater booster seat includes braces integral with said first seat platform and said side walls for laterally reinforcing said side walls when said seat is utilized by said child.

8. The assembly of claim 6 wherein said first child theater booster seat includes a support rib co-extending along the bottom of said seat platform for restricting the bowing of said seat platform when said seat is utilized by said child.

9. A child theater booster seat for use in a child theater booster seat assembly for facilitating the viewing of movies and the like by children or diminutive persons for use in a row of adult theater seats having spaced apart arm rests, said children theater booster seat comprising:

a seat platform for seating said child;

a plurality of side walls extending upwardly from said seat platform;

a plurality of support arms extending generally outward from said plurality of side walls for overlapping said arm rests of said adult theater seat and supporting said seat platform whereby said seat platform is suspended within said space separating said arm rests;

an interlocking means for interlocking said child theater booster seat with a second respective of said child theater booster seat.

10. The seat of claim 9 wherein said child theater booster seat is a unitary structure.

11. The seat of claim 9 wherein said interlocking means includes said child theater booster seat having a male extension for interlocking said seat with said second respective of said child theater booster seat.

12. The seat of claim 9 wherein said interlocking means includes said second respective of said child theater booster seat having a male extension, said child theater booster seat having a female receptacle for receiving said male extension and interlocking said child theater booster seat with said second respective of said child theater booster seat.

13. The assembly of claim 9 wherein said child theater booster seat is molded from plastic.

14. The assembly of claim 13 wherein said child theater booster seat includes a brace integral with said seat platform and with said side walls for laterally reinforcing said side walls when said seat is utilized by said child.

15. The assembly of claim 13 wherein said child theater booster seat includes a support rib co-extending along the bottom of said seat platform for restricting the bowing of said seat platform when said seat is utilized by said child.

16. A booster seat assembly for supporting children in adjacent adult theater seats and the like having spaced apart arm rests, said booster seat assembly comprising:

a first child booster seat of unitary construction having a first seat platform for seating a first child;

a first plurality of side walls extending upwardly from said first seat platform;

a first plurality of support arms extending generally outward from said first plurality of side walls, said first plurality of support arms overlapping said arm rests of said adult theater seat for supporting said first seat platform;

a second child booster seat of unitary construction having a second seat platform for seating a second child;

a second plurality of side walls extending upwardly from said first seat platform;

a second plurality of support arms extending generally outward from said second plurality of side walls, said second plurality of support arms overlapping said arm rests of said adult theater seat for supporting said second seat platform;

an interlocking means for interlocking said first child booster seat with said second child booster seat.

17. The assembly of claim 16 wherein said interlocking means includes said first child booster seat having a male extension and said second child booster seat having a female receptacle for receiving said male extension and interlocking said first child booster seat with said second child booster seat.

18. The assembly of claim 17 wherein said first child booster seat is molded from plastic.

19. The assembly of claim 18 wherein said first child booster seat includes a brace integral with said first seat platform and with said side walls for restricting the lateral movement of said side walls when said seat is utilized by said child.

20. The assembly of claim 19 wherein said first child booster seat includes a support rib co-extending along the bottom of said first seat platform for restricting the bowing of said seat platform when said seat is utilized by said child.

* * * * *